US010221037B1

(12) United States Patent
Blasbalg

(10) Patent No.: US 10,221,037 B1
(45) Date of Patent: Mar. 5, 2019

(54) ELECTRICAL CABLE STORAGE APPARATUS

(71) Applicant: Paul Andrew Blasbalg, Barrington, RI (US)

(72) Inventor: Paul Andrew Blasbalg, Barrington, RI (US)

( * ) Notice: Subject to any disclaimer, the term of this patent is extended or adjusted under 35 U.S.C. 154(b) by 341 days.

(21) Appl. No.: 15/367,240

(22) Filed: Dec. 2, 2016

Related U.S. Application Data

(60) Provisional application No. 62/263,827, filed on Dec. 7, 2015.

(51) Int. Cl.

| | |
|---|---|
| ***B65D 25/28*** | (2006.01) |
| ***B65D 85/04*** | (2006.01) |
| ***B65H 75/28*** | (2006.01) |
| ***B65H 75/40*** | (2006.01) |
| ***B65H 75/44*** | (2006.01) |

(52) U.S. Cl.
CPC ..... *B65H 75/28* (2013.01); *B65D 25/2802* (2013.01); *B65D 85/04* (2013.01); *B65H 75/406* (2013.01); *B65H 75/4402* (2013.01); *B65H 75/4471* (2013.01); *B65H 2701/34* (2013.01)

(58) Field of Classification Search
CPC .. B65H 75/28; B65H 75/406; B65H 75/4402; B65H 75/4471; B65H 2701/34; B65D 25/2802; B65D 85/04
See application file for complete search history.

(56) References Cited

U.S. PATENT DOCUMENTS

| | | | | |
|---|---|---|---|---|
| 4,061,290 | A * | 12/1977 | Harrill | B65H 75/40 191/12.2 R |
| 4,306,688 | A * | 12/1981 | Hechler, IV | B65H 75/40 242/397 |
| 4,467,979 | A * | 8/1984 | Koehler | B65H 75/40 191/12.4 |
| 4,557,430 | A * | 12/1985 | Bonhard | B65H 75/4471 191/12.2 R |
| 4,725,697 | A | 2/1988 | Kovacik | |
| 6,786,428 | B1 * | 9/2004 | Huang | B65H 75/40 137/355.16 |
| 2003/0015617 | A1 * | 1/2003 | Chuang | B65H 54/585 242/395 |

(Continued)

*Primary Examiner* — William E Dondero
(74) *Attorney, Agent, or Firm* — Shalom Wertsberger; Saltamar Innovations

(57) ABSTRACT

An electric cord storage and deployment device offering safe and convenient deployment, retraction, and storage of the cord both at deployed and retracted states. The device comprises a reel upon which the cord having plugs at each end, may be spooled. The reel has a hub compartment dimensioned for storing at least a portion of one plug and a length of cord to which the plug is coupled. During deployment the plug not disposed in the hub compartment is connected to a receptacle, and the reel is brought near the second receptacle. The plug in the hub compartment safely rotates with the reel and is protected within the hub compartment to prevent tangling or personal injury. When the cord storage device is near the second receptacle the plug stored in the hub may be withdrawn with the length of cord stored in the compartment and coupled to the second receptacle. Additional features for protecting the cord, easing deployment, and storage of the device are also provided.

17 Claims, 15 Drawing Sheets

(56) References Cited

U.S. PATENT DOCUMENTS

| | | | | |
|---|---|---|---|---|
| 2003/0173417 | A1* | 9/2003 | Lu | B65H 75/40<br>239/197 |
| 2004/0251368 | A1* | 12/2004 | Wu | B65H 75/40<br>242/395.1 |
| 2018/0289915 | A1* | 10/2018 | Rhyan | A61M 16/0672 |

* cited by examiner

ELECTRICAL CABLE STORAGE APPARATUS

FIELD OF THE INVENTION

The present invention is directed generally to electrical cable storage apparatuses, and more particularly to reels for storing and deploying electrical cable having connectors coupled at both ends.

BACKGROUND OF THE INVENTION

Vessels such as boats and ships oftentimes contain internal electrical power generation and distribution systems which supply the vessel needs while underway. However in port it is common for such vessels to be connected to external supply known in common parlance, and in these specifications, as 'shore power'. The concept of connecting to external power is not limited to marine vessels, and other vessels, such as aircrafts, trucks, recreational vehicles such as road transportable dwellings, and even specialized containers such as refrigerated containers, utilize cables as shore, or utility, power connection.

In common parlance shore, or utility, power cables are referred to as 'cords'. A cord has a connector, colloquially known as a 'plug' on each end, for coupling to matching receptacles. Notably oftentimes the connection is carried out by cables that are heavy and bulky. Generally there are two different types of plugs, a Male and a Female type, however in these specifications no distinction is made and the term plug may relate to either a male or a female plug, or to a combination thereof, and the cord may have any desired plug type on each end.

Storing, deploying, retrieving, and handling of cords cause significant inconvenience. The cords tend to bend and sometimes get tangled during these activities and storage. Deployment is also inconvenient as it requires untangling and drawing the cord from the receptacle supplying the energy (referred to as supply receptacle hereinunder) to a receptacle mounted on or in the vessel (referred to as vessel connector hereinunder) and then organizing the length of unused cord at a selected place along the cord length.

Cable reels are well known in the art, and are generally constructed of a handle or a housing, and a hub rotatably mounted thereto. The hub has two opposing sides extending radially beyond the hub outer dimensions. One end of the cord (referred to as the proximal end hereinafter), is laid in the reel and the reel is rotated about the housing, whereby the length of the cord is coiled about the hub. Certain reel sides have an opening to allow the plug at the proximal end of the cord (referred to hereinunder as the proximal plug) to be located outside reel, or to allow better coiling of the cord. The opposite end of the cord, and the corresponding plug shall be referred to hereinunder as the distal end and the distal plug respectively. Notably the term 'end' should be construed to include the actual end of the cord, and the cord portion adjacent thereto.

While conventional cable reels ease cable management solution for storage and deployment, they suffer from several shortcomings: firstly, as the hub is occupied by the rotating mechanism, the proximal plug must protrude from the reel side, or be enclosed by the cord which is rolled around and above it. When the proximal plug protrudes, it is exposed to mechanical injury, or may cause an injury or get entangled during cord deployment. Moreover, in order to connect the plug to the receptacle, a short length of cord (referred to hereinunder as the standing part of the cord) is required to cover the distance between the receptacle and the reel. If such a standing part is left outside the reel, it will move wildly due to the rotation of the reel, entangling and endangering humans, equipment, and the cord and plug itself.

U.S. Pat. No. 4,725,697 to Kovacik et al. teaches an extension cord reel disposed in a carrying case formed of two cup-shaped halves, the reel which also include two halves include a pair of duplex outlets and a circuit breaker. A cord is reeled onto the reel, the cord having a plug on one end and the other end is permanently coupled to the outlets, and cannot be accessed while the reel is assembled. The outlets are rotatable with the reel, and no access is provided to the compartment in which the outlets are mounted. Thus the Kovacik Patent does not offer the ability to extend a plug and a standing part of the cord for connection to the vessel or the shore receptacle.

There is therefore a clear and heretofore unanswered need for a cord management solution that would store and protect the cord, allow easy deployment and retraction, and provide for easy connection between the plugs and receptacles, without requiring unspooling of the whole length of cord.

SUMMARY OF THE INVENTION

It is a goal of the present invention to provide a cord management reel that stores and protects the reel, cord, and at least one of the plugs coupled thereto, and which facilitates easy deployment and retraction. Furthermore, it is a goal of the present invention to allow unreeling the cord while protecting a proximal plug and allowing extending the proximal plug and the standing part, for connection to a receptacle.

To that end, in an aspect of the invention, there is provided a cord storage apparatus for storing an electrical cord having a distal end with a distal plug coupled thereto and a proximal end with a proximal plug coupled thereto. The cord storage apparatus comprising a housing, a reel rotatably supported by the housing, the reel having a rotation axis and a plurality of parallel planes orthogonal to the rotation axis. The reel comprises a hub having a longitudinal axis substantially parallel to the rotation axis, the hub having a hub perimeter. The perimeter has a medial plane orthogonal to the longitudinal axis, an outer perimeter, and an inner perimeter. The inner hub perimeter at least partially defines a center compartment which has sufficient volume to store therein the proximal plug and a portion of the cord. The center compartment has at least one opening. The hub perimeter has a via extending at least between the outer perimeter portion and the inner perimeter portion, the via dimensioned to allow at least the cord to pass therethrough. In certain embodiments two reel walls extend outwardly from the hub and are rotatable therewith, the reel walls being disposed on opposing sides of the hub perimeter preferably substantially parallel to the medial plane. The reel has a bearing portion, and in some embodiments at least one of the reel walls has at least one reel bearing portion distal to the hub. In some embodiments both reel walls have bearing surfaces, in yet other embodiments the reel bearing is disposed centrally to the reel, such as at the hub or adjacent thereto, and in some embodiments a combination of a central bearing and a reel wall bearing is utilized. The housing has at least one housing bearing portion formed to interface with the reel bearing portion for rotatably supporting the reel.

The via allows the cord to pass through the reel hub into the compartment, and the hub compartment size allows storage of the proximal plug and the running part of the cord therewithin. This arrangement allows rotation of the reel while the proximal plug and standing part of the cord are stored within the compartment such that they rotate with the reel during deployment of the cord, yet allow easy extension of the proximal plug and connection to a receptacle while the reel is placed at a distance smaller or equal to the standing part. In certain embodiments the via may be larger than the cord diameter.

Optionally at least one of the reel walls defining at least one wall opening formed in the wall, the wall opening is sufficiently large to allow passage of the proximal plug, the opening also being coupled to the via for passing the cord through the via to the hub compartment. Further optionally, at least one of the reel walls is substantially radial and the reel bearing portion is disposed at the circumference of the wall.

The housing of the cord storage apparatus has at least one slot defined thereby, the slot being angled to the rotation axis, and dimensioned to allow the cord to pass therethrough. In some embodiments the slot is dimensioned to allow the distal plug to pass therethrough, and optionally the housing has a space proximal to the slot for storage of the distal plug at least partially, or entirely, within the housing. In many embodiments in the slot is substantially at right angle to the rotation axis, reducing rolling resistance when the cord is being deployed.

In some embodiments at least one of the reel walls comprises a plurality of arms extending from the hub. In such embodiments reel bearing portions may be embodied in an area of the arms distal to the hub. In other embodiments the reel wall is primarily solid, and in others the wall comprises a combination of solid portions and openings of various sizes.

In certain embodiment the housing comprises a plurality of supporting legs and at least one support member having a bearing portion for rotatably supporting the reel.

In some embodiments the housing bearing portion is at least partially in direct contact with the reel bearing portion. The term direct contact should be construed to include an optional lubricant layer between the housing bearing portion and the reel bearing portion. However in certain optional embodiments the reel bearing portion comprises a plurality of bearings and the interfacing of the reel bearing portion and the housing bearing portion occurs via the bearings. In certain alternative optional embodiments, the housing bearing portion comprises a plurality of bearings, and wherein the interfacing of the housing bearing portion and the reel bearing portion occurs via the bearings.

Optionally, the reel further comprises a handle for facilitating reel rotation. In certain embodiments the handle is rotatable between deployed state and stored state, and in some embodiments when the handle is in the stored state is acts cover at least a portion of the hub compartment opening. Further optionally, the housing comprises a carrying handle.

Optionally, for facilitating stacking of a plurality of cord storage apparatuses the apparatuses comprise at least a protrusion disposed on one side of the housing, and a complementary indentation disposed on an opposite side of the housing, in a location allowing mating of the indentation of a first cord storage apparatus with the protrusion of a second cord storage apparatus. One potential example of such protrusion 950 and an indentation 960 are depicted in FIG. 10, where matching but opposing protrusion and indentation would be disposed on the other side of the housing. Notably, in such embodiment a different rotation handle 140, or no rotation handle, would likely be utilized. Many similar matching structures will be cleared to the skilled in the art to ease stacking of the cord storage devices.

In some embodiments at least one of the reel walls further comprises a reel lateral bearing portion. The lateral bearing portion assists in keeping the reel within the housing. It is located distal to the hub. The housing has at least one housing lateral bearing portion dimensioned to interface with the reel lateral bearing portion for rotatably supporting the reel. Similar to the reel and housing bearing portions, the interface between lateral bearing portions may be embodied such that the housing lateral bearing portion comprises a plurality of bearings, and wherein the interfacing of the housing lateral bearing portion and the reel lateral bearing portion occurs via the bearings, or alternatively, such that the reel lateral bearing portion comprises a plurality of bearings, and wherein the interfacing of the housing lateral bearing portion and the reel lateral bearing portion occurs via the bearings.

Optionally, a hub lip coupled to the hub perimeter or being integral thereto, is provided. The lip extends inwardly into the hub towards the longitudinal axis at or adjacent to the hub opening. The lip thus facilitates keeping the proximal plug and the standing part of cord in the hub when the cord is stored. Further optionally, the hub may have one or more removable covers that when installed keep the hub closed and contains the proximal plug and the proximal portion of the cord. Such covers may cover the hub openings completely or partially. In some embodiments such covers comprise a rotating handle or a portion thereof.

Optionally, the via is sufficiently large to allow the cord to pass therethrough, but not sufficiently large to allow the proximal plug therethrough. However, in some embodiments, the via is large enough to allow the proximal plug to pass therethrough between the hub and the cord spool.

In certain embodiments the body has a bearing portion which is coupled to one of reel walls at the center of the reel or proximal to the hub, while the opposing reel wall has a bearing portion distal to the hub.

SHORT DESCRIPTION OF DRAWINGS

The summary above, and the following detailed description will be better understood in view of the enclosed drawings which depict details of preferred embodiments. It should however be noted that the invention is not limited to the precise arrangement shown in the drawings and that the drawings are provided merely as examples.

Figure 10:
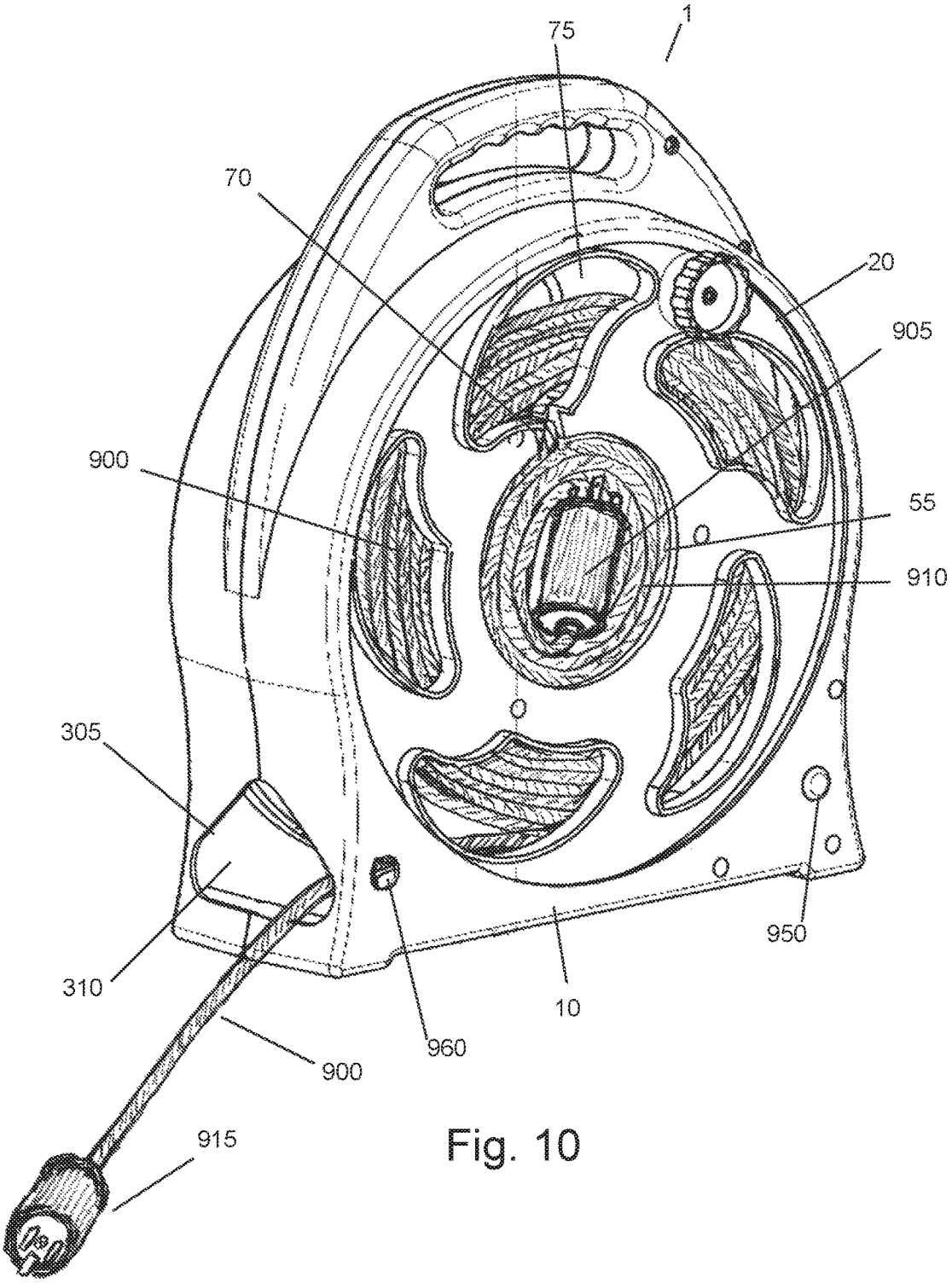

FIG. 10 schematically depicts the cord storage device during a deployment.

Figure 10A:
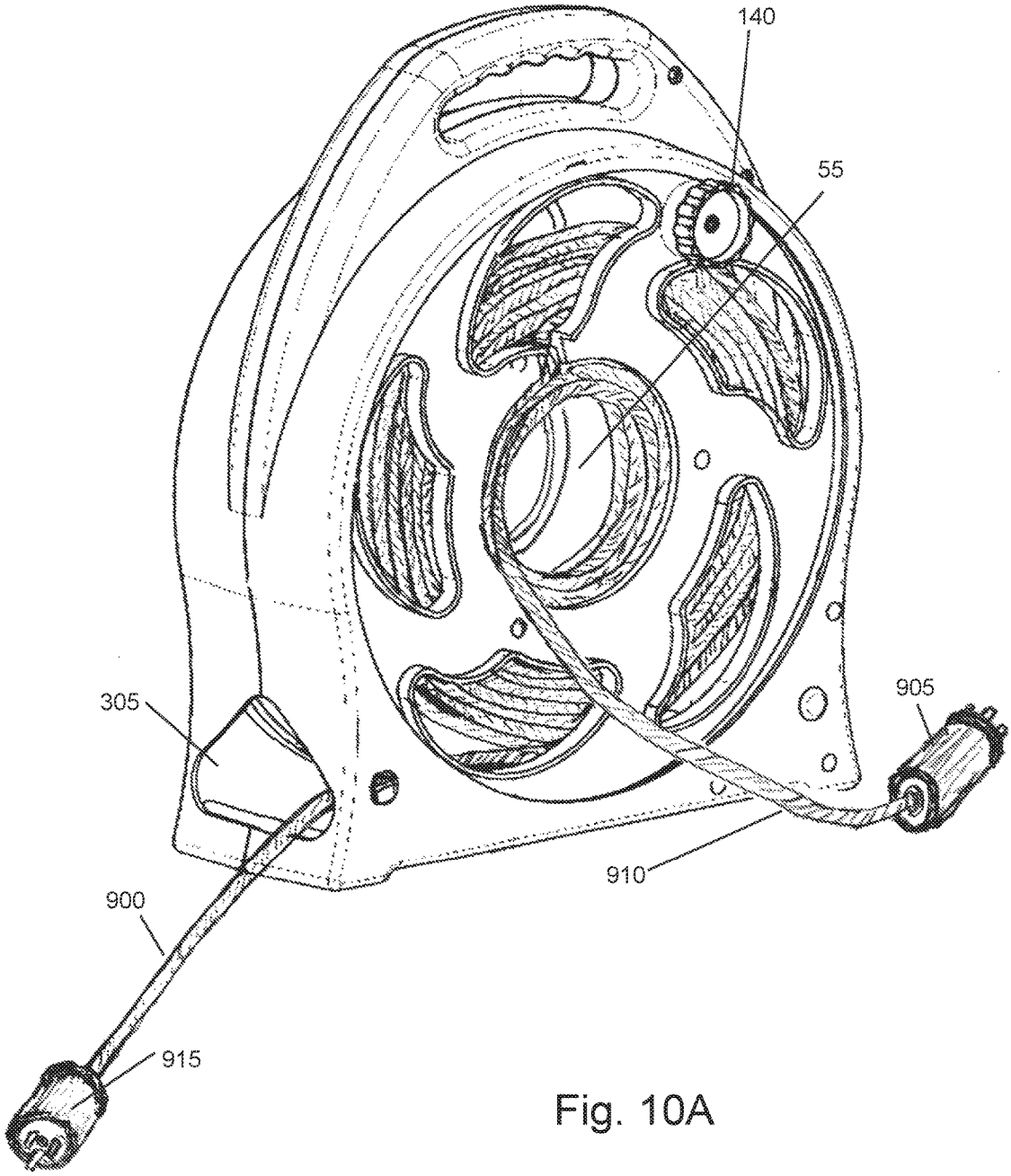

FIG. 10A schematically depicts the cord storage device in a deployed state.

DETAILED DESCRIPTION

The following description of an embodiment of the invention with several options, in combination with the attached drawings would assist understanding the principles of the present invention.

Figure 1:
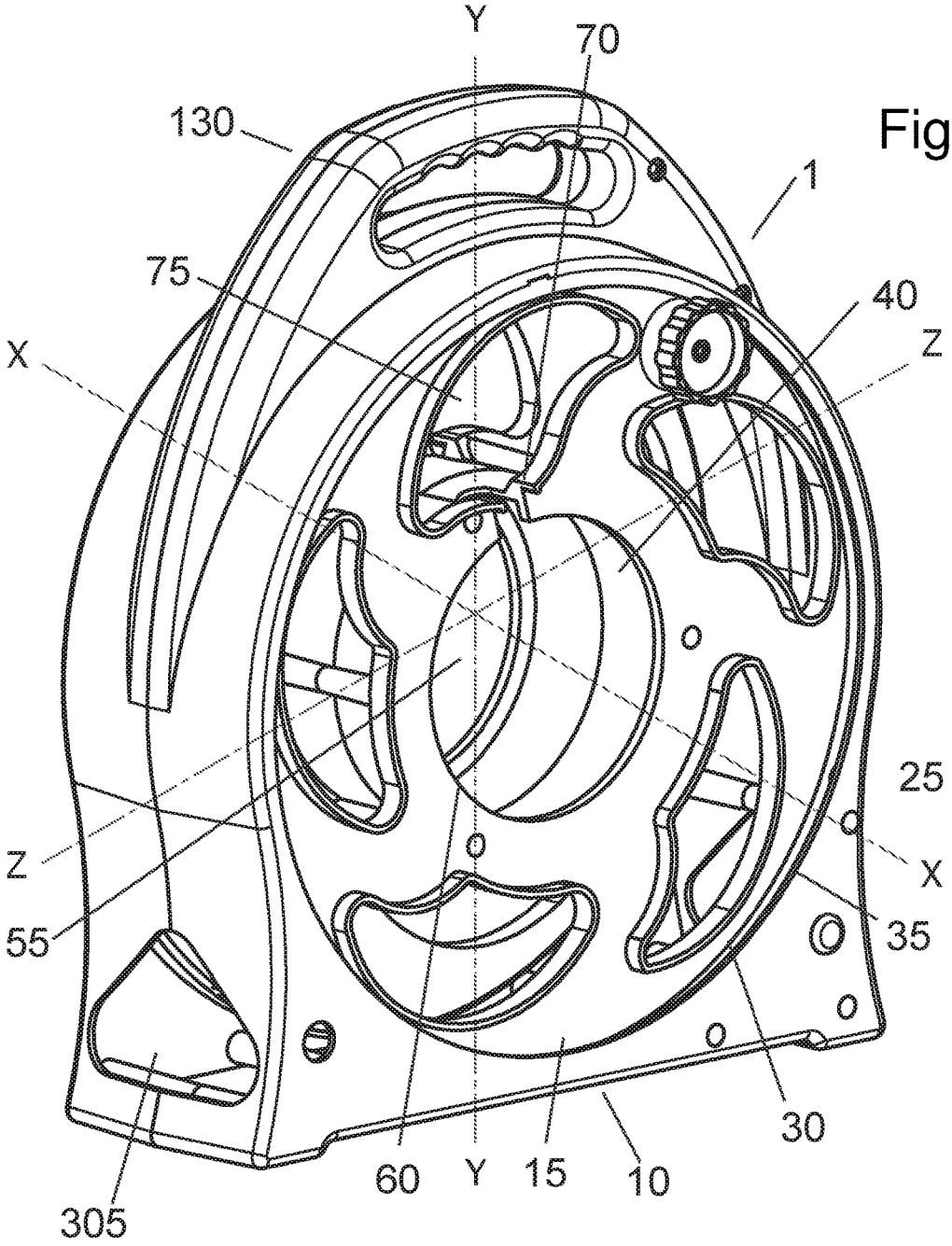
FIG. 1 depicts an isometric view of an embodiment of the invention.

FIG. 1 depicts an isometric view of an embodiment of cord storage device 1 in accordance with the present invention. The device comprises a housing 10 and a reel 15.

Figure 4:
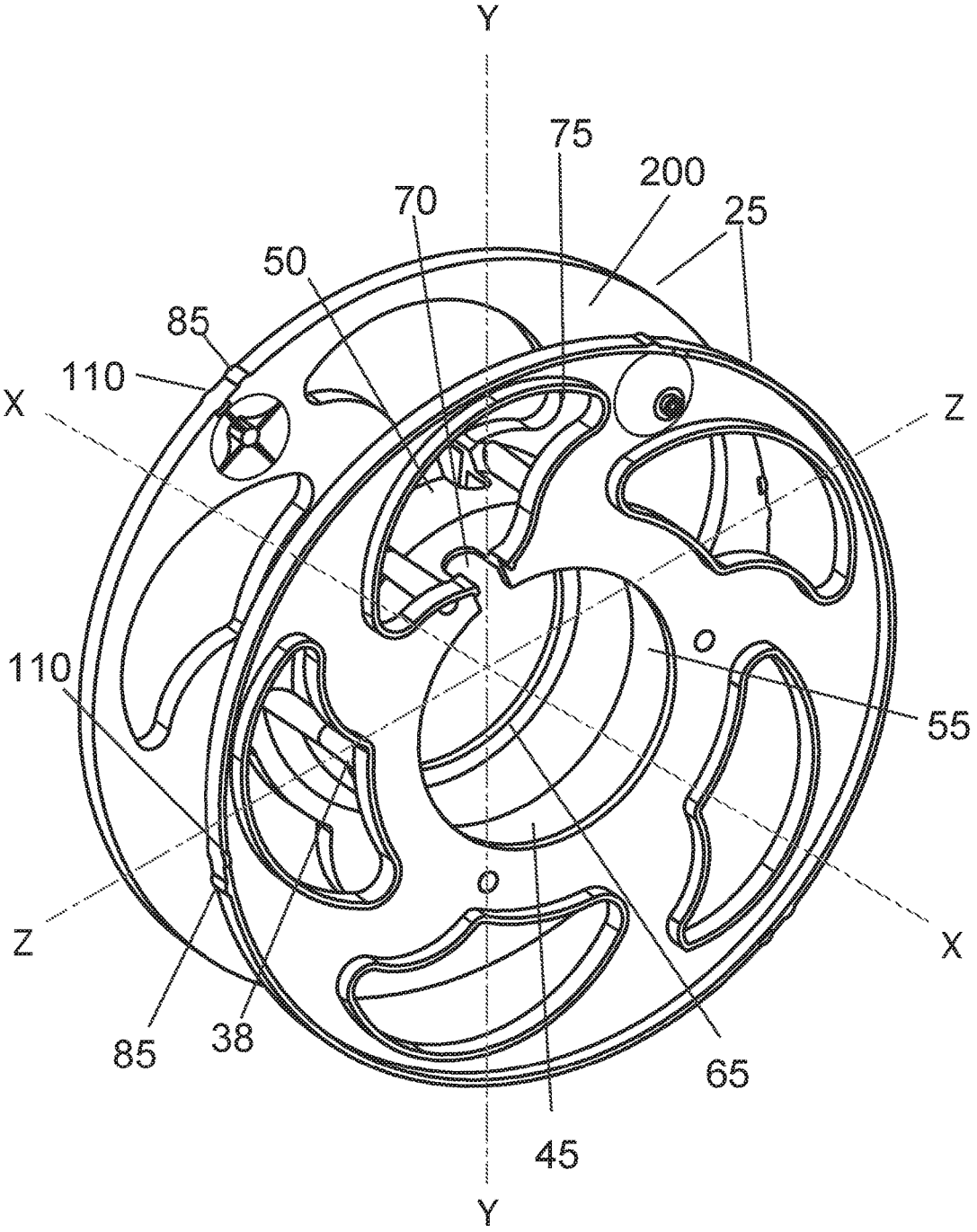
FIG. 4 depicts a closer view of the reel.

The reel has a rotational axis X-X. FIG. 4 axis lines Y-Y and Z-Z, which lie in the medial plane. The reel has a hub 20 and reel walls 25 extending away from the hub. The reel is rotatably supported by the housing by at least one cooperating housing bearing portion and reel bearing portion respectively.

The hub 20 has a hub envelope 40 which may be a solid wall as shown, a frame such as a wire frame, or ribs. By way of example, screw ribs 38 may be disposed at or adjacent to the hub envelope or may define the envelope. The hub envelope 40 has an internal 45 and external 50 perimeters. The outer perimeter defines the inner reel limit into which the cord is spooled, while the internal perimeter at least partially define the hub compartment as described below.

The external hub perimeter combined with the reel walls form the cord spool 200, in which the majority of the cord is coiled during storage. A via 70 extends between the external and internal hub perimeters.

The internal hub perimeter defines the external boundary of a hub compartment 55. In many embodiments the center of the hub compartment is congruent with the rotational axis, but this is not mandatory. The compartment has an opening 60 that is generally in a plane orthogonal to the rotation axis, i.e. parallel to the medial plane. In many embodiments the hub compartment is open at both ends, as may be seen in the figures, but a single opening is sufficient. The hub opening 60 is at least sufficiently large to pass the proximal plug. Notably, the hub and the hub compartment may extend beyond the opening, and the hub envelope may be angled to the opening, however the opening should be construed as any plane that is parallel to the medial plane, that lies in any portion of the hub, and which provides the required opening dimension. The hub compartment 55 is defined at least by the internal hub perimeter, the one opening, and optionally by a second opening, a partial opening, or a compartment wall, on the opposite side of the reel along the rotation axis.

The hub compartment 55 define a volume of space sufficiently large to accommodate therein at least the proximal plug or a portion thereof, and a length of cord. The cord passes through the via 70 from the outer hub perimeter to the inner hub perimeter, i.e. into the hub compartment. The length of cord disposed in the compartment is referred to as the standing part, as opposed to the 'running part' which is the portion of the cord extending from the outer hub perimeter towards the distal plug. The standing part is of sufficient length to allow connection of the cord to a receptacle while the cord storage device is placed close to the receptacle, such as a power post, a dock, the ground, the vessel, and the like. In most cases a distance of a meter or less will suffice but hub compartments of varied volumes are contemplated to answer specific needs and design choices.

In certain embodiments an optional lip 65 is provided on at least one side, of the hub compartment, and in embodiments where the hub compartment is opened on both sides of the reel, the optional lips are commonly but not necessarily provided on both sides. The lip facilitates containment of the proximal plus and the standing part within the compartment during cord deployment. The features of the via and the compartment of sufficient volume for maintaining the proximal plug and the standing part provide a unique utilitarian advantage to the cord storage device: it allows keeping the plug and the running part of the cord internal to the reel, inside the hub compartment, and free to rotate with the reel without interfering with, or coming in contact with, fixed parts of the cord storage device. The protective chamber for storing the proximal plug in the reel, allows the plug to rotate securely with the reel when the cord is being deployed, and allows the plug to be connected to the socket by easily removing the proximal plug and sufficient length of the standing part of the cord from the hub compartment to achieve such connection without having to unspool the whole cord from the cord spool 200, or using a short patch cord between a socket permanently connected to the reel, and the receptacle. It is therefore also an important feature of the invention that the standing part of the cord is stored at the hub during stored, deployment, and/or retraction phases, but may be pulled out of the hub when the storage device 1 is deployed. This arrangement allows placing the cord storage device 1 close to the socket, but in a safe and convenient way, without the risk of tangling, or causing a dangerous obstacle. Notably, a single cord, terminated on both ends with appropriate plugs, may be utilized as the cord is passed through the via, and the same cord is used without requiring intermediate plugs, brushes, a separate patch cord to connect between the cord and the receptacle, and the like.

The novel and advantageous aspect of the invention which calls for a central hub having sufficient free volume to store at least a standing part of the cord and the proximal plug or a portion thereof such that the proximal plug is either completely or partially held within the hub compartment may be advantageously utilized in storage devices which utilize a central shaft and/or bearing arrangement, where the reel is supported by any support mechanism that is disposed at the center of the reel, rather than in its periphery. While such embodiment is not shown, it would be clear to the skilled in the art that such reel support disposed at the center of rotation may be coupled to one reel wall while allowing sufficient volume to store the standing part and the proximal plug or a sufficient portion thereof to securely support the plug and have it rotate with the reel during the deployment and/or retraction phase.

It is noted that in embodiments having a central shaft and/or bearing arrangement on one side of the reel, a different bearing mechanism may be utilized on the other side wall of the reel. By way of example the bearing mechanism may support the periphery of the reel wall, the hub, or any other convenient bearing arrangement.

In certain embodiments, optional cover (Not shown) is provided to close the hub and contain the proximal plug and cord for storage. The cover or covers may cover the hub opening completely or partially, and may be deployed on one side or on both sides of the reel, however at least one cover or a portion thereof is removable, so as to allow extraction of the proximal plug and the standing part. When covers are provided lip or lips may also be provided, but the covers function to contain the proximal plug and the standing part in the compartment.

In certain embodiments optional handles and/or other containment members assist in containing the proximal plug within the hub compartment (not shown). In certain embodiments optional straps, ties and/or other containment members assist in containing the proximal plug within the hub compartment for storage (not shown). It is noted that each of the opening on the reel sides may utilize a different containment mechanism, or no containment mechanism, and symmetry of containment mechanisms is not required. The selection of containment mechanism, or abstaining from using such mechanisms, is a matter of technical choice.

The via 70 is formed in the hub envelope. The via is dimensioned to allow the cord to pass between the hub compartment 55 and the cord spool 200 which surrounds it.

In some embodiments the via completely surrounds the cord as it passes into the hub compartment, however this requires a permanent or semi-permanent attachment of the cord to the reel. In other embodiments one of the reel walls have a reel wall opening 75, sufficiently large to allow passage of the proximal plug. The via is coupled to the opening, and this feature allows a user to thread the proximal cord end from the spool, and pass the cord through the via, and then store the proximal plug and the standing part in the hub compartment. In such embodiments, the via 70 and the reel wall opening are connected such that the connection allow the cord to be passed through the via. Notably a plurality of reel wall openings may optionally be provided, to reduce weight and material costs, and to assist in cooling of the cord when it carries current.

The hub compartment taking up the center of the reel hampers the use of the center of the reel as an axle of rotation. Certain embodiments of the invention accommodate a rotational arrangement such as a shaft and bearings within the hub (not shown). While simple to manufacture, sturdy and convenient, such central shaft arrangements impart larger volume requirement on the hub compartment. In the depicted embodiments, in order to support the reel to the housing and allow it to rotate, the reel has a bearing portion 30 that is distal to the hub. The reel bearing portion interfaces with a housing bearing portion 35, and the reel is supported via this interface. This arrangement of rotational bearing away from the center of the reel offers larger usable volume within the hub without demanding enlarging of the device as a whole.

While certain embodiments may be made with a single reel wall with the housing constructed to limit the reel on the opposite side thereof, the shown embodiments are presented with two reel walls. Similarly bearing placement may be made in several locations, as discussed herein and as will be clear to the skilled in the art in light of the teachings of the present invention. In the embodiment of FIG. 1 at least one of the reel walls, and more commonly both, have a reel bearing portion 30. The reel bearing portion is disposed away from the hub, near or at the edge of the wall, and the reel is rotatably supported by the housing via the reel bearing area, which interfaces with a matching housing bearing area 35. In other embodiments, the reel wall may end near the hub, and the housing extends inward to contain the cord. In this embodiment the bearing surface is located near the hub. Notably, the bearing arrangement does not have to symmetric, and thus in certain embodiments one of the reel walls utilizes a bearing surface at or near the distal edge of the wall, while the other wall has the bearing portion near the hub, or the bearing portion may be at the center of the reel.

In preferred embodiments, the reel walls 25 may be of any convenient design, including a solid wall, a web, or merely a few arms. In embodiments having the bearing portion on the wall, as the reel turns, the bearing portion 30 of the reel wall subscribes a bearing perimeter. The interface between the reel and the housing occurs in at least a portion or portions of the bearing perimeter, and potentially encompass all the bearing perimeter. It is important to understand that while the bearing perimeter may be physically subscribed by the reel wall, such as with a reel wall having a complete round perimeter, the bearing perimeter may also be conceptually formed, as a circle subscribed by the reel bearing portion or portions when the reel rotates about the rotation axis X-X. Furthermore, portions of the reel or reel walls wall may extend beyond the bearing perimeter.

The reel bearing portion may be at any portion of the reel wall, except that it has to allow spooling of the proximal plug through the opening of the hub compartment. In some embodiments, the reel wall is round, and the perimeter of the wall acts as a reel bearing portion, as shown in the figures. In other embodiments (not shown) the hub wall may comprise of a web or arms, and the bearing portion is not continuous about the bearing perimeter. In other embodiments, the reel wall may end near the hub, and the housing extends inward to contain the cord. In these embodiments the reel bearing surface is disposed near the hub, while still allowing the removal of the proximal plug and the standing part when the reel is at rest. In yet other embodiments the reel wall and the housing wall may overlap, meeting at the bearing surface.

Figure 5:
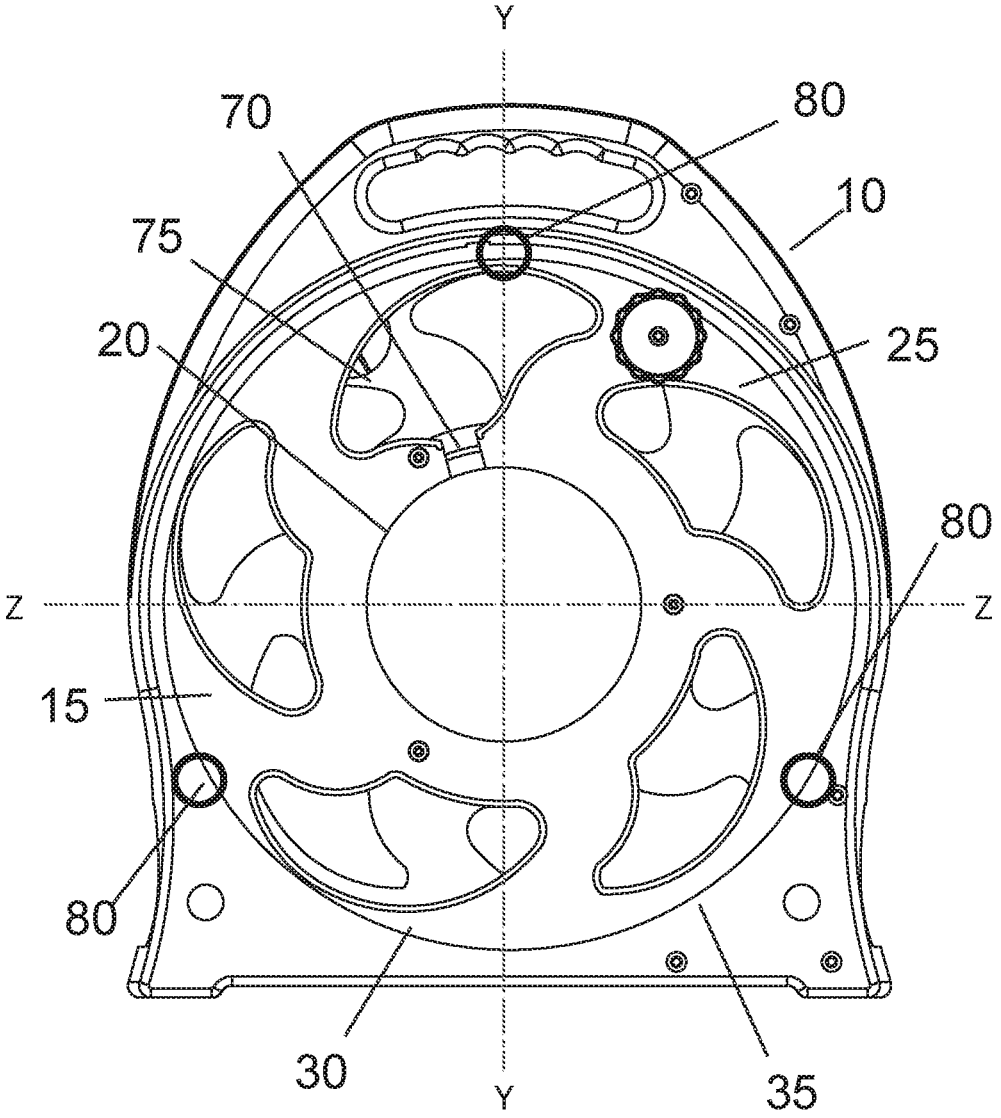
FIG. 5 depicts optional placement of bearings along the bearing perimeter.

In certain embodiments the reel bearing portion 30 is in direct contact with the housing bearing portion 35. In optional embodiments between the reel and the housing is reduced by having only segments of the bearing portion of either the reel or the housing come into contact with the respective opposite part. Such segment is termed a 'bearing' and a plurality of such bearings is normally used. Bearings may used on either the reel or the housing, to reduce friction while supporting the weight of the reel and providing smooth deployment. Bearings may be stationary structures such as protrusions in the bearing portion, or rotatable structures, such as balls, rollers, and the like. An example of one optional placement of such bearings is provided in FIG. 5, showing one optional disposition 80 of such bearings, however any number of bearings may be utilized and the may be deployed at any desired location along the bearing perimeter.

Figure 6:
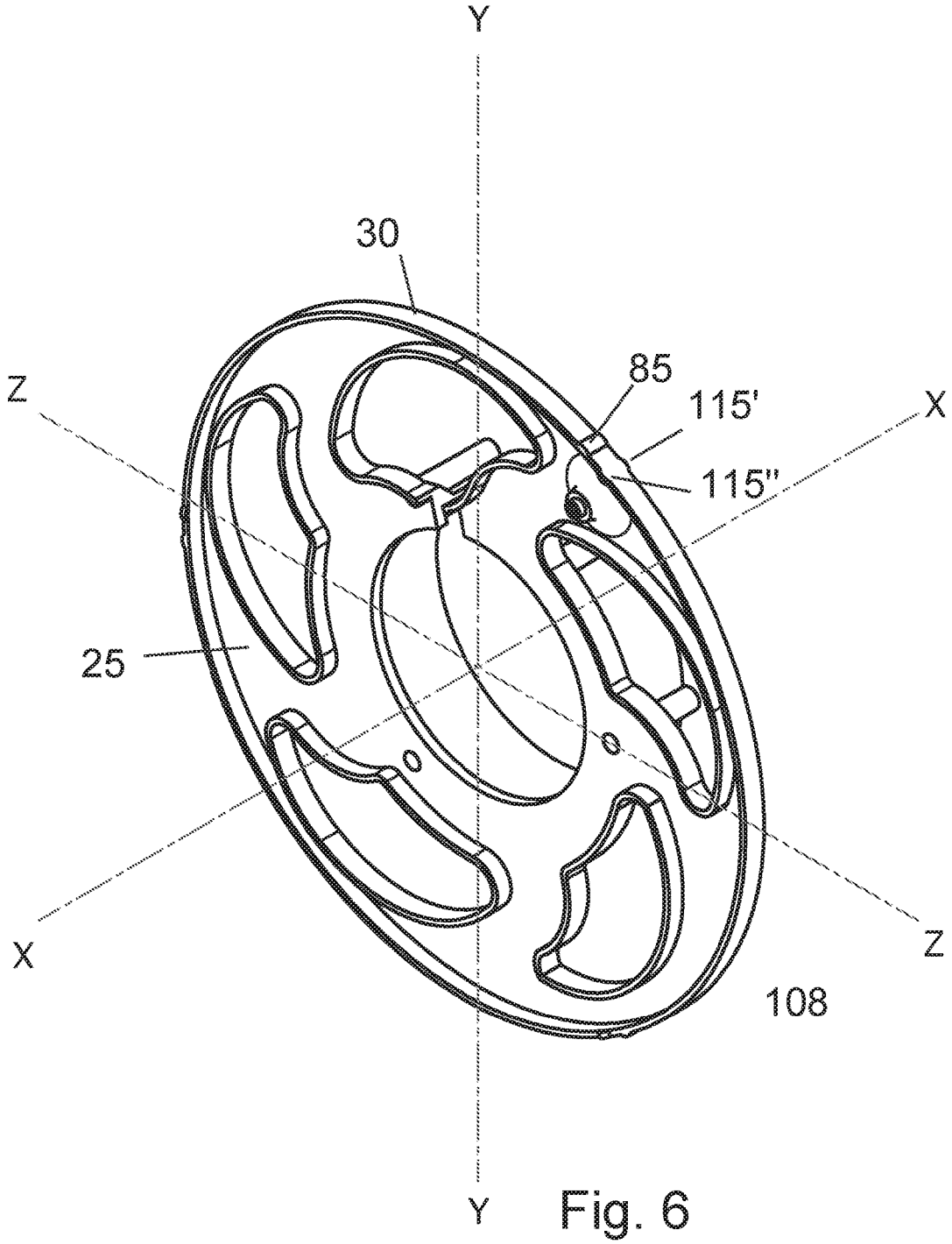
FIG. 6 depicts a reel half showing overview of optional bearing placement on the reel.

FIG. 6 depicts a reel with bearings 85 and 115, located on the reel bearing portion 30. The skilled in the art would readily understand that the shown bearings are merely representative of a potential plurality of bearings. The bearing 85 provides weight carrying support, while bearing 115 provide lateral support as explained below. Bearing 115' is designated for one type of lateral support, while bearing 115" is designed for another type of lateral support, as will be explained below, however the numeral 115 will be used to explain the function of both 115' and 115", unless otherwise specified.

Figure 6A:
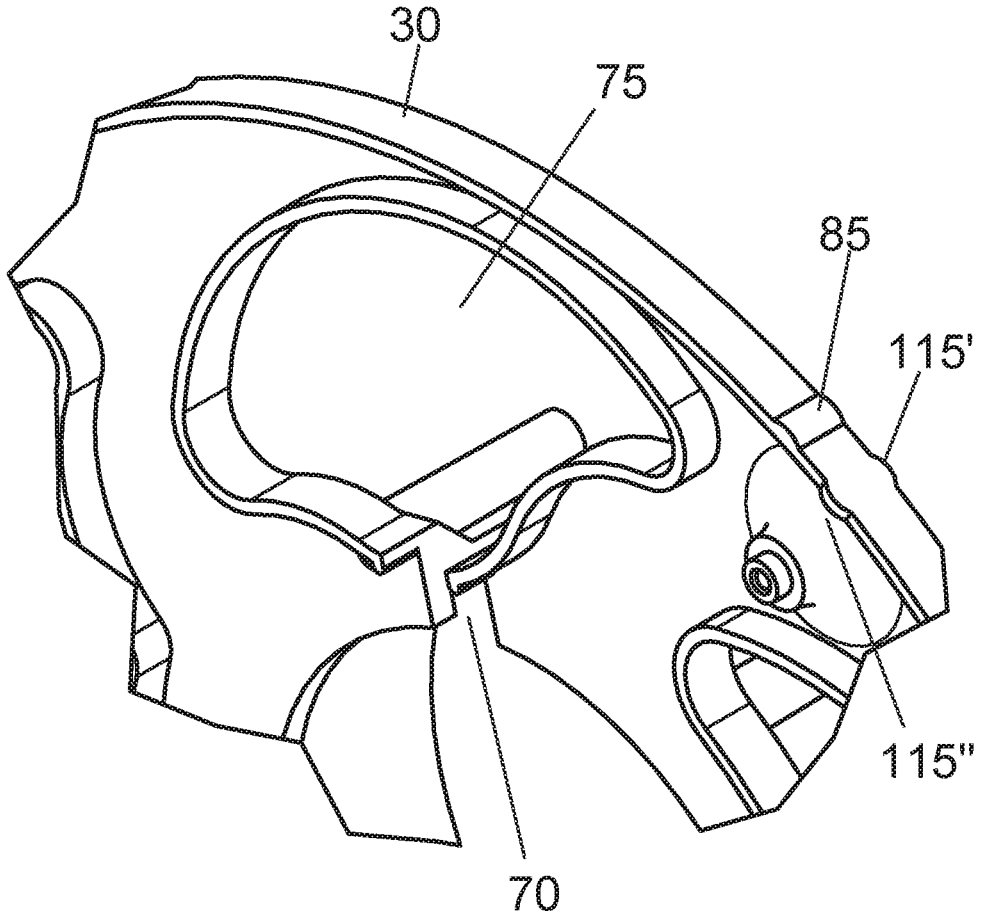
FIG. 6A depicts an enlarged detail of the reel of FIG. 6.

FIG. 6A depicts a close up example of a reel weight support bearing 85 located on the reel bearing portion. A plurality of such bearings is provided and the number and location of those bearings are a technical decision. The type of bearing is similarly a technical decision, driven for example by such considerations as the weight of the cord, cost, strength of the cord, consumer preferences, regulatory compliance, and the like.

Figure 7:
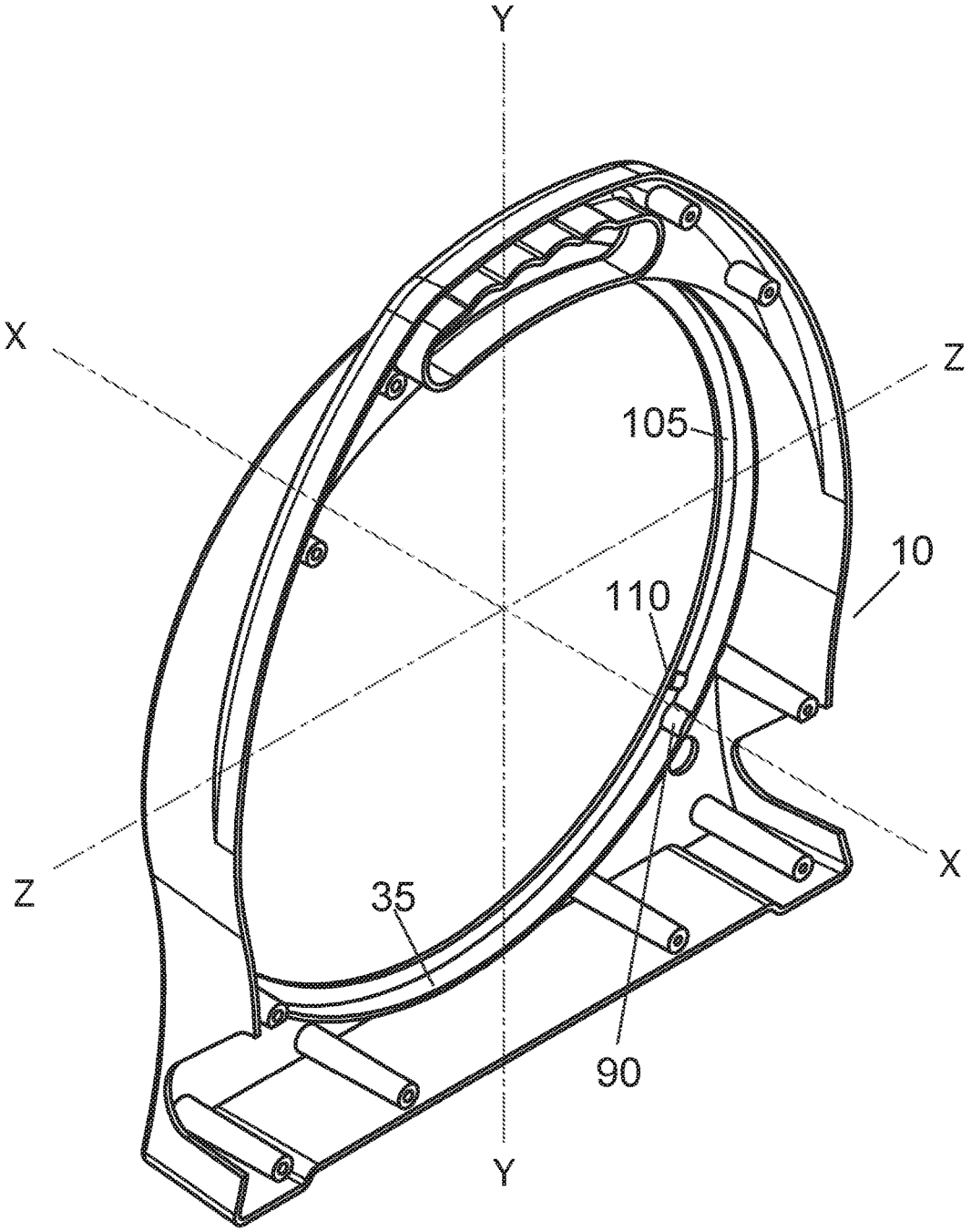
FIG. 7 depicts a housing half showing overview of optional bearing placement on the housing.
Figure 7A:
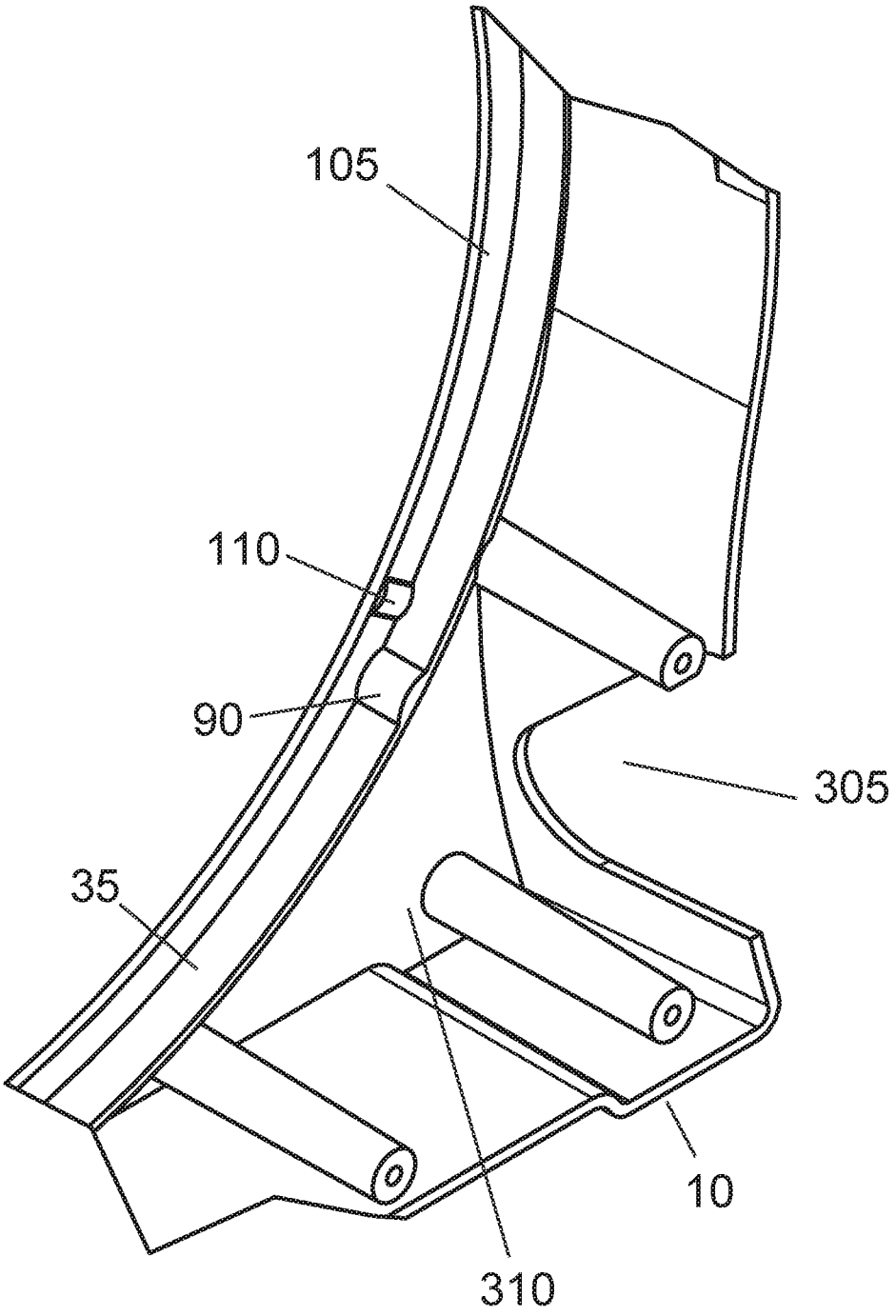
FIG. 7A depicts an enlarged detail of the housing half of FIG. 7.

FIGS. 7 and 7A depict an example embodiment having weight support bearing 90, however those bearings are disposed on the housing. The selection between locating the bearing on the housing or on the reel is also a technical decision. Similar to the embodiment of FIGS. 6 and 6A the number of bearings and their location is a technical decision. It is mentioned again that the use of nay bearings between the reel and housing bearing portions is merely optional, and that if used the bearing may be of any desired construction.

In addition to supporting the weight of the reel and allowing the reel to turn within the housing, the cord storage apparatus provides lateral containment portion or portions. The containment portions act to prevent the reel from departing the housing, such as being dislodged sideways, generally in parallel to the rotation axis, by way of example. Containment portions may be embodied internally or externally to the housing, and may be disposed on the housing, the reel walls, or in combination therebetween. Generally the respective bearing portions support at least the weight of the reel, but in certain embodiments they are also used as the containment portion.

FIG. 7 depicts one side of the housing of the cord storage device 1, and FIG. 7A depicts a close-up detail of a section of the housing. A containment lip 105 is provided on the housing. The containment lip 105 acts as a containment portion and prevents the reel from departing from the housing. Similar to the bearing portions, the lateral containment portion need not be continuous. By way of example, simple screws may provide containment by being screwed into the housing such that their heads extend to support a respective containment portion on the reel.

In some embodiment, a plurality of lateral bearings 110 are provided on the lip 105 or on another housing containment portion 105 to reduce friction. In other embodiments, such lateral bearings 115" are provided on the reel containment portion 108. In yet other embodiments no bearings are provided, and containment portion on either the reel or the housing is in direct contact with the respective housing or reel containment portion.

The skilled in the art would recognize the many ways in which containment of the reel in the housing may be achieved. By way of example, the reel walls may have portions (not shown) which extends further distally to the hub than the bearing perimeter. If both of the reel walls have such extension portions they will act as against the housing to prevent the reel being dislodge from the housing.

Figure 8:
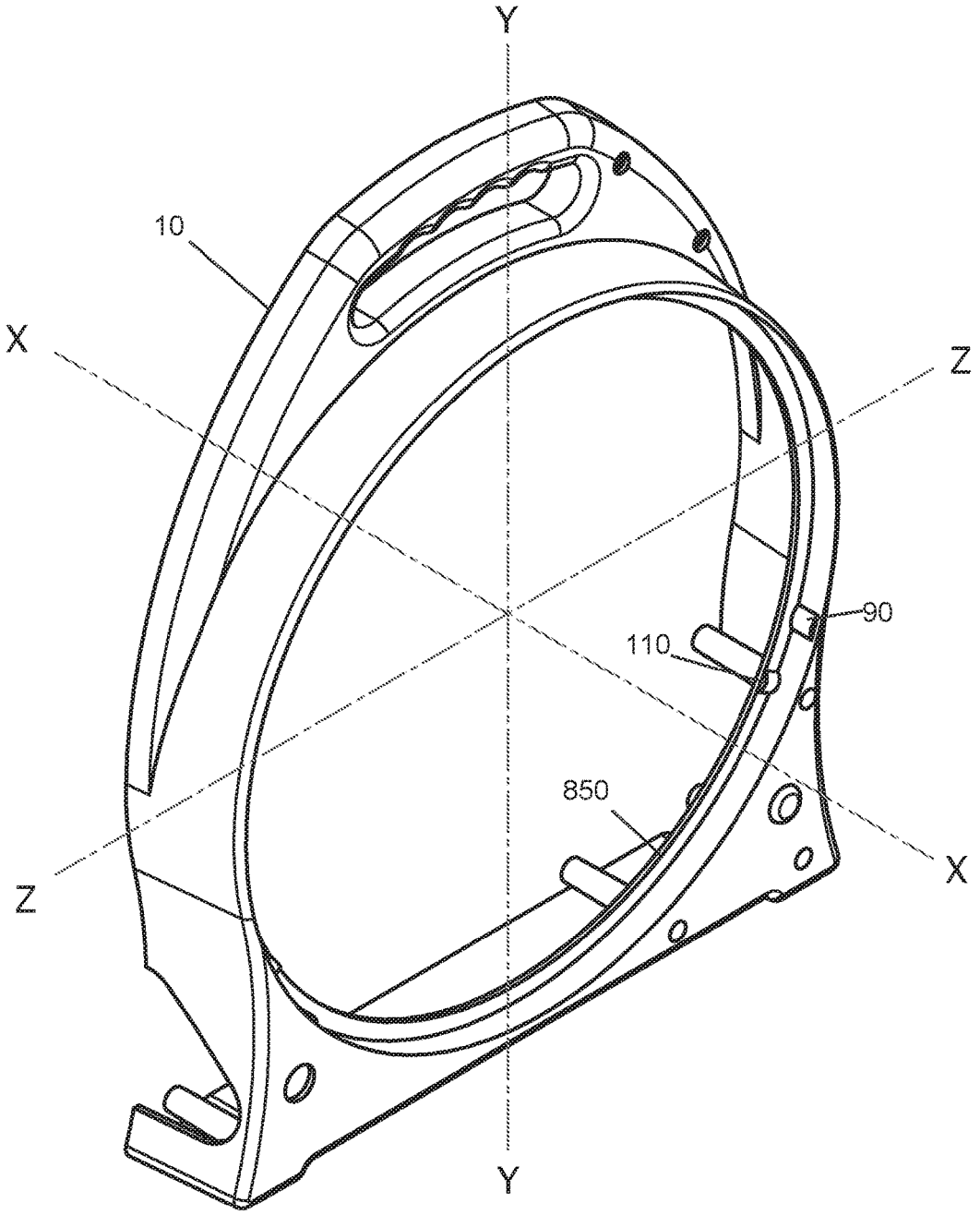
FIG. 8 depicts a housing half showing overview of optional bearing placement on the housing.
Figure 8A:
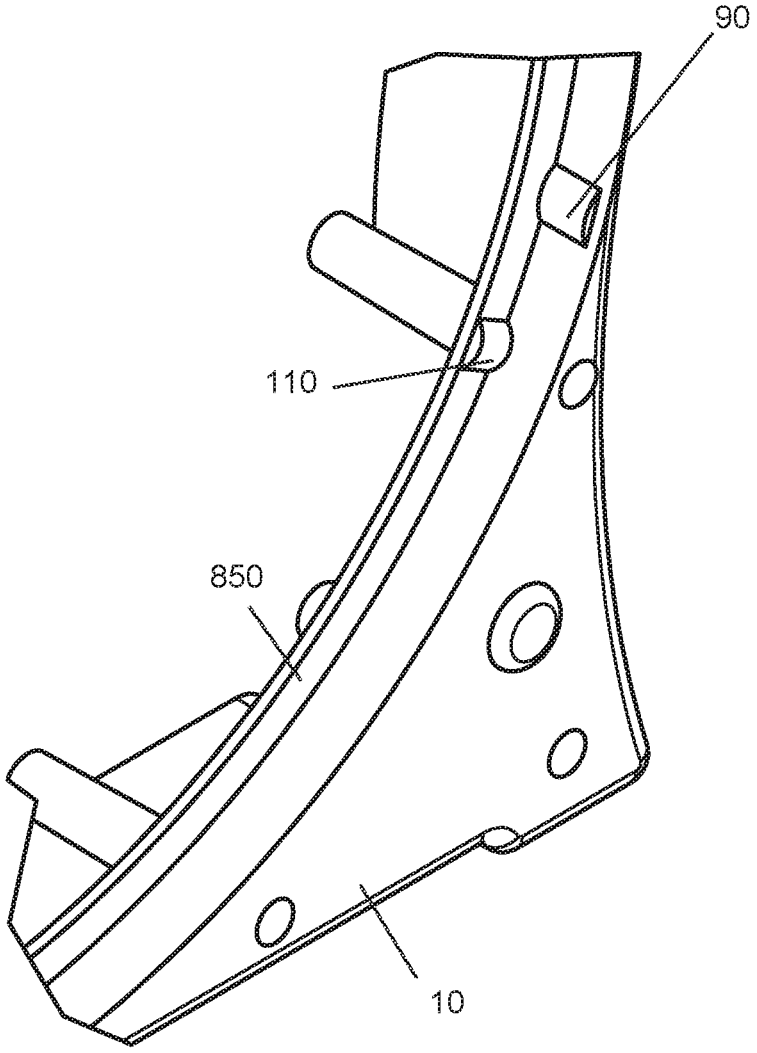
FIG. 8A depicts an enlarged detail of the housing half of FIG. 8.

Yet another form of containment is depicted in FIGS. 8 and 8A. FIG. 8 depicts one side of the housing shell and FIG. 8A depicts close-up detail of a portion thereof. In this embodiment the containment lip 850 is located away from outer perimeter of the housing. In such an embodiment the reel is assembled such that the reel walls are used as the reel containment portion and they at least partially enclose the housing containment lip, such that the lip wall lies further from the medial plane Y-Z than the housing containment lip 850. in some embodiments the reel containment portion and the housing containment portion are in direct contact with each other, while in other embodiments lateral bearings are used. The bearings 810 may be disposed as denoted in FIG. 8, or alternatively be disposed on the reel, enumerated as 115' in FIGS. 6 and 6A.

The skilled in the art would recognize that having interfacing bearings on the housing and the reel would interfere and would prevent smooth rolling. Thus if weight bearings 85 are used on the reel, weight bearings 90 on the housing would not normally be used, and vice versa. Similarly if lateral bearings 110 or 810 are used on the housing, reel lateral bearings 115' and/or 115" will also interfere, and thus normally only one or the other arrangements will be used. It is however noted that lateral bearing may be disposed on one of the housing and the reel, and weight bearings may be disposed on the respective opposite bearing portion. Moreover, an intermediate bearing member (not shown) may be placed between the housing and the reel, and act as a bearing to both. It is noted again that the use of bearing is not mandatory to the invention.

As described the housing must support the reel and allow for rotation of the reel therein, as well as prevent the reel from falling out of it. In embodiments using a central bearing preventing the reel from falling out is done simply by cupping the shaft, or by similar mechanism. While several example embodiments using bearing portions distal to the hub are detailed, the person skilled in the art of mechanical design would readily recognize that many combinations of bearing arrangements are known and available for rotatably supporting the weight of the reel by the housing, and preventing the reel from falling out of the housing, and any such design that supports the reel should be considered adequate.

Figure 2:
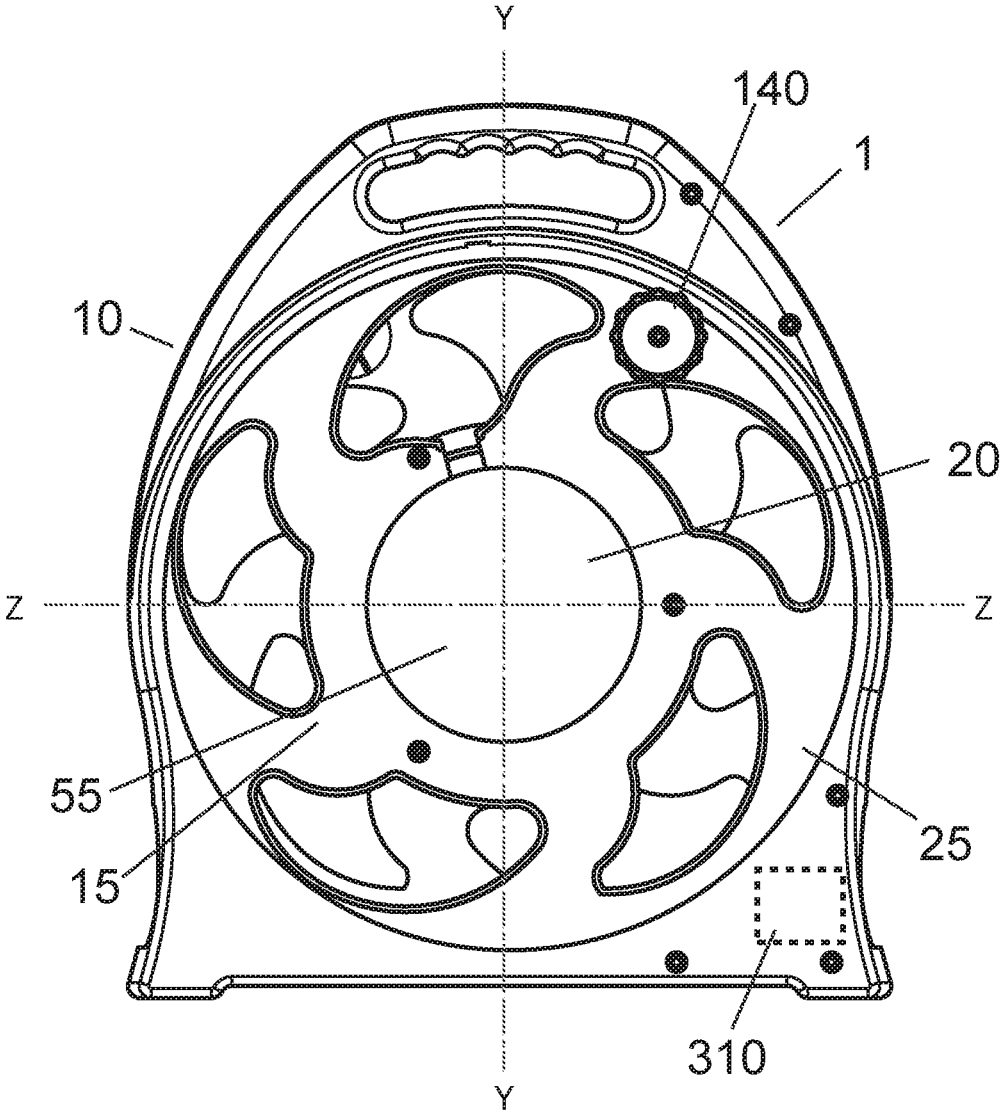
FIG. 2 depicts a front view of the embodiment of FIG. 1.
Figure 3:
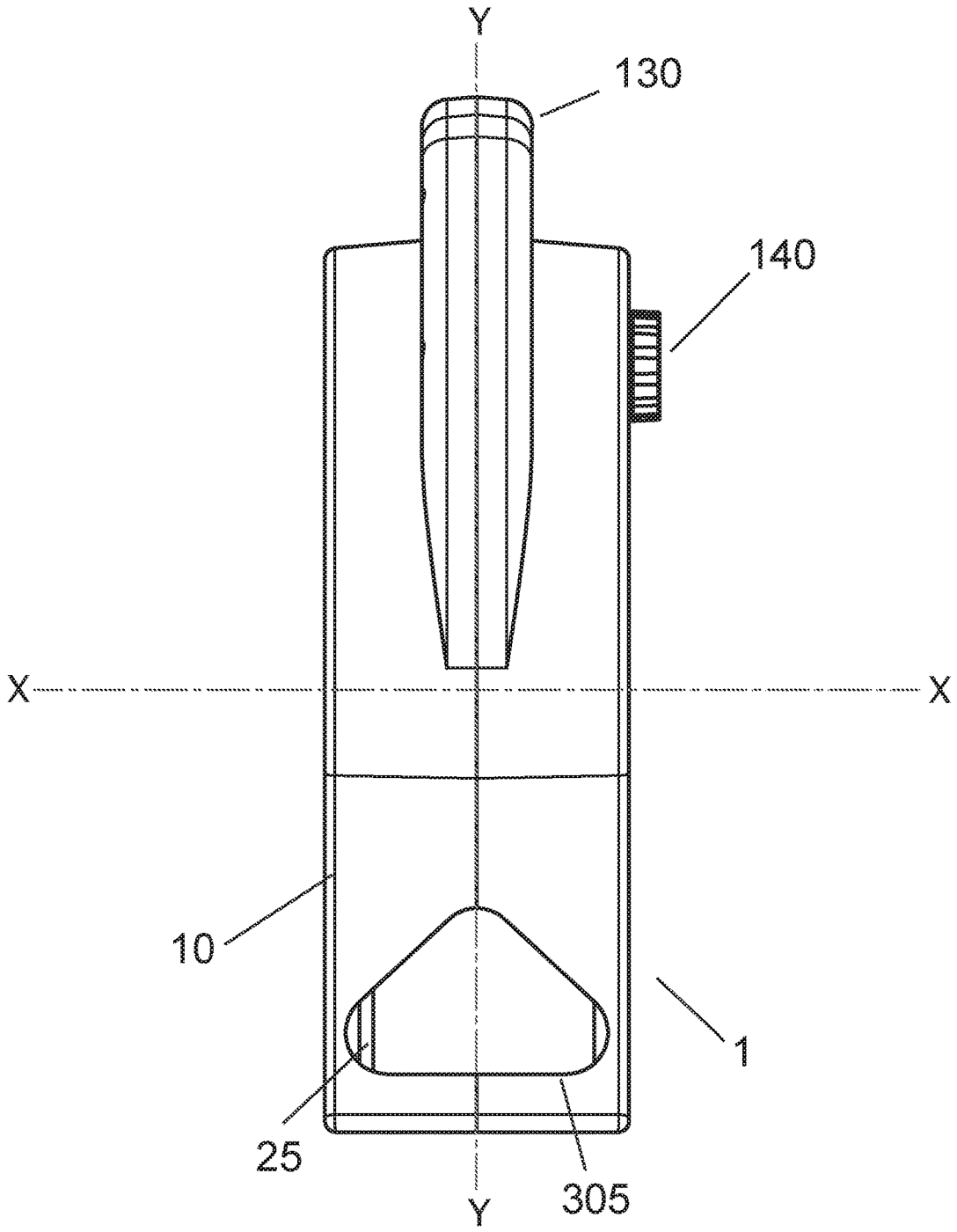
FIG. 3 depicts a side view of the embodiment of FIG. 1.

The housing acts to substantially contain the reel, allow it to rotate therein, and keep the cord from dislodging over the edge of the reel sidewalls. A feed notch 305 is shown in several of the drawings. In many embodiments two feed notches are provided on opposite sides of the housing. The feed notch 305 is angled to the rotational axis X-X, and preferably disposed orthogonally to the Y-Z plane, such that a cord fed therethrough may be substantially at right angles to the rotation angle. Such arrangement will allow paying the cord out from the spool or reeling it onto the spool with relative ease. The feed notch must allow at least the cord to pass therethrough, but in many embodiments is dimensioned sufficiently large to pass the distal plug therethrough. In many embodiments the housing also have one or more distal plug storage space(s) 310 (shown schematically as internal space in FIG. 2 and in FIG. 7) to store the distal plug therein when the cord is stored. Furthermore, in many embodiments the notch is sufficiently large to accommodate passing the proximal plug therethrough. It is common that the distal and proximal plugs are of the same dimensions, and in such embodiments no further changes are required to the dimensions of the feed notch.

In certain embodiments the housing further comprises one or more carrying handle(s) 130. Further optionally, the reel may be equipped with a rotation handle 140 which may be affixed to the reel, slidingly, or hingedly attached thereto. In certain embodiments the rotation handle is foldable into the hub compartment (Not shown). Such design provides at least partial closing of the hub compartment to help contain the proximal plug therein during cord deployment, while facilitating easy reeling of the cord when the cord is collected into the apparatus. In some embodiments the optional rotation handle may be slidingly mounted into slots formed in the hub or reel walls (not shown).

The storage apparatus may come with the cord already installed therein, or a user may install the cord in the storage apparatus. In other embodiments the user thread the cord through the feed notch and into the via, and couples the proximal plug to the cord end extending into the cord end extending into the hub. The distal plug may be pre-installed, or may be similarly coupled.

Figure 9:
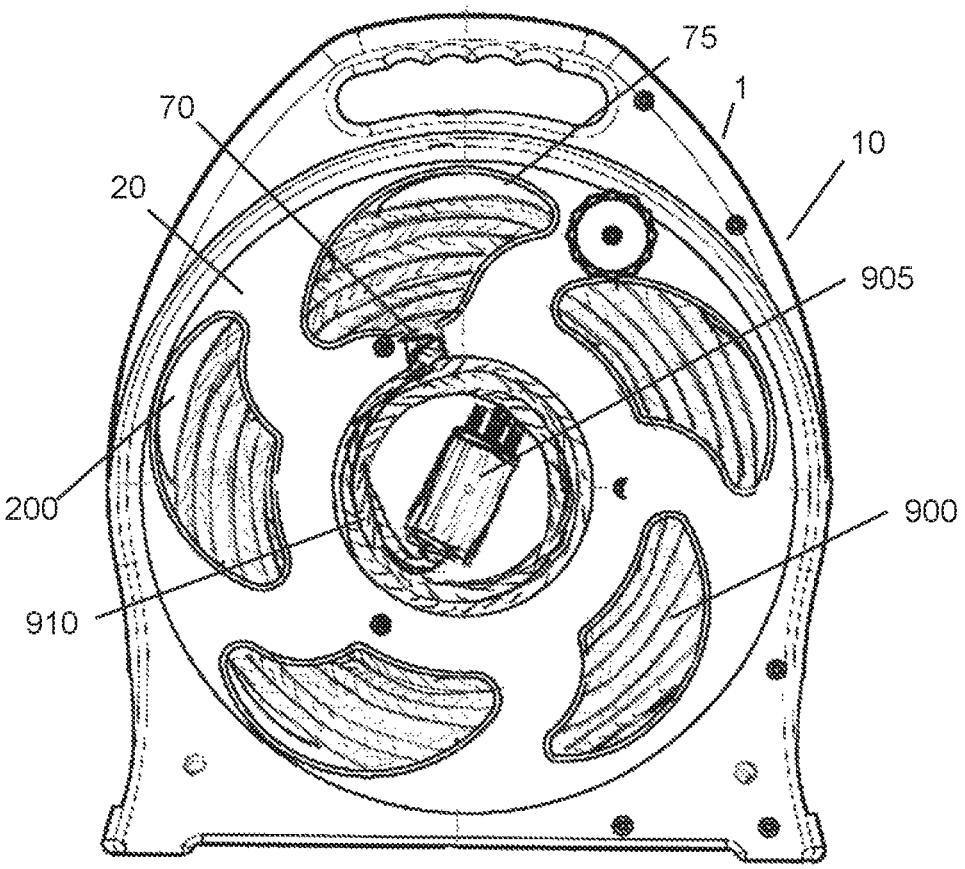
FIGS. 9 and 9A depict a front and side view respectively of a cord storage device with the cord in stored state.
Figure 9A:
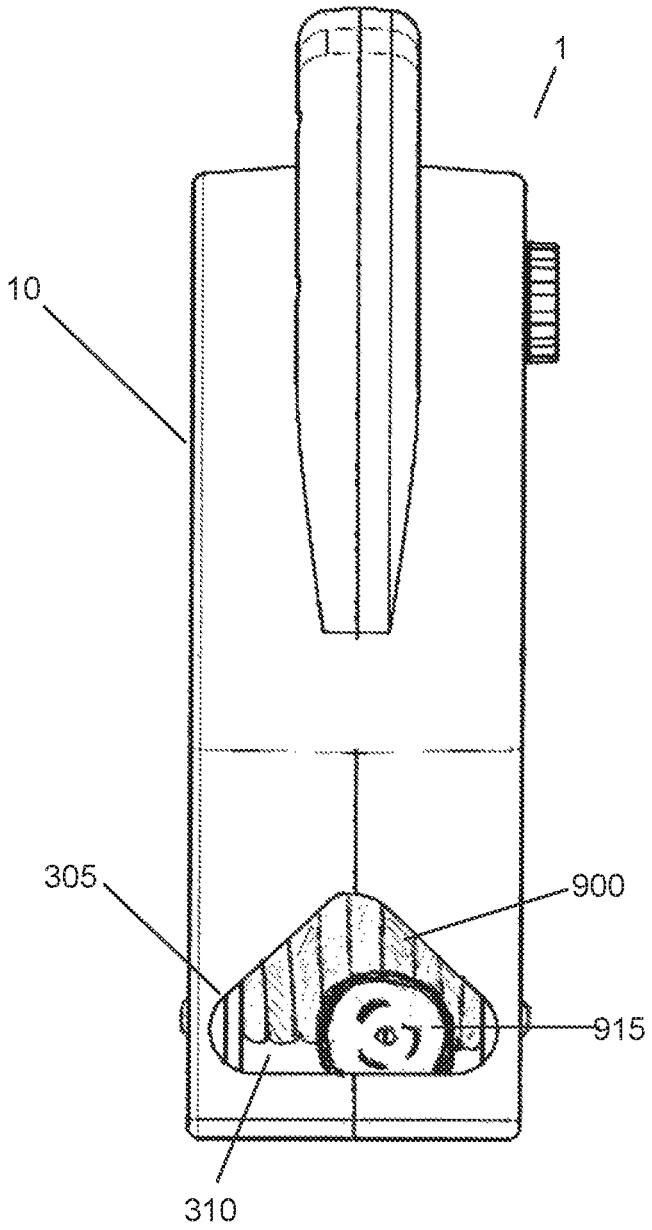

FIG. 9 depicts a front view, and FIG. 9A depict a side view, of a cord storage device 1 having a cord 900 spooled therein. Cords are commonly supplied in the market as a complete assembly with both plugs attached thereto. The embodiment presented in the drawings depicts an example embodiment that allow the user to easily install the cord 900 into the cord storage apparatus. In accordance with the depicted embodiment, the user will thread the proximal plug 905 into the housing via the feed notch 305, into the cord spool volume. The user will then pass the proximal plug, together with a portion of the cord, through the opening 75 in the reel wall. The user then threads the cord through the via 70 into the hub compartment, and folds the length of cord which shall become the standing part 910, and the proximal plug 905 in the hub compartment. In embodiments where the via is sufficiently large, the user will pass the proximal plug, together with the standing part directly through the via, without needing to first pass it through the hub wall opening 75. The user may then rotate the reel, which will spool the running part of the cord into the cord spool space 200. The distal plug 915 may then be stored in the distal plug space 310. Thus the cord, including the two plugs, is fully stored within the cord storage apparatus. Optional covers, or other containment apparatus, may be installed to assure containment of the proximal plug and cord within the hub during storage.

The following deployment example shall assume that when deployed, the distal plug is to be coupled into a supply receptacle, and the proximal plug is to be coupled to the vessel receptacle. FIG. 10 depicts the cord storage device 1 during deployment, and FIG. 10A depicts the device with the cord deployed and ready to be plugged into the respective receptacles (like many of the drawings, the depiction is not to scale). When cord deployment is desired, the user plugs the distal plug 915 into the supply receptacle (not shown), or otherwise lays or secures the cord in the vicinity of the supply receptacle. The user than carries the cord storage apparatus 1 to the vicinity of vessel receptacle (not shown). The reel rotates as it is being pulled by the cord which is paid out via the notch 305. The proximal plug 905 is contained within the hub compartment 55, and rotates with the reel 20. When the user carrying the apparatus arrives near the vessel receptacle, the cord storage apparatus 1 is placed in a convenient location, such as on the deck or floor of the vehicle, in a storage chamber, or hung by any type of mount such as a hook, a strap, a rope, a stake, a specially made fixture, and the like. As shown in FIG. 10A The proximal plug 905 is removed from the hub compartment, together with any desired portion of the standing part 910, and the proximal plug can then be coupled to the vessel receptacle without the need to unwind the complete cord length, or a patch cord. The cord itself is stored in the apparatus 1 which protect the cord from entanglement and protects personnel form a dangerous obstacle. A similar operation can be accomplished with distal plug being attached at the vessel, and then when the user carrying the apparatus arrives near the shore power receptacle, the cord storage apparatus 1 is placed near the supply receptacle and the proximal plug is coupled thereto Retraction may occur at the opposite order.

It is noted that the terms 'distal' and 'proximal' are merely relative, and should be considered as names provided for convenience rather than an explicit or implicit limitations of the items described or named by the relevant term, and does not necessitates the relevant item as being at the extreme edge of the reference object. Furthermore, the terms 'plug' and 'receptacle' merely indicate matching electrical connectors, and do not imply neither male nor female type connectors.

It will be appreciated that the invention is not limited to what has been described hereinabove merely by way of example. While there have been described what are at present considered to be the preferred embodiments of this invention, it will be obvious to those skilled in the art that various other embodiments, changes, and modifications may be made therein without departing from the spirit or scope of this invention and that it is, therefore, aimed to cover all such changes and modifications as fall within the true spirit and scope of the invention, for which letters patent is applied.

I claim:

1. A cord storage apparatus for storing an electrical cord having a distal end with a distal plug coupled thereto and a proximal end with a proximal plug coupled thereto, the reel comprising:

a housing;

a reel at least partially disposed within the housing, the reel having a rotation axis and a plurality of parallel planes orthogonal to the rotation axis, the reel comprising:

a hub having a longitudinal axis substantially parallel to the rotation axis, the hub having a hub envelope having a medial axis orthogonal to the longitudinal axis, an outer perimeter, and an inner perimeter, the inner perimeter at least partially defining a center compartment; the center compartment having sufficient volume to store therein the proximal plug and a portion of the cord and having at least one opening in one of the parallel planes, the perimeter further having a via extending at least between the outer perimeter portion and the inner perimeter portion, the via dimensioned to allow the cord to pass therethrough, but not sufficiently wide to allow the proximal plug therethrough;

two reel walls extending outwardly from the hub and rotatable therewith, the reel walls being disposed on opposing sides of the medial axis, at least one of the reel walls having at least one reel bearing portion distal to the hub;

wherein:

the housing having at least one housing bearing portion formed to interface with the reel bearing portion for rotatably supporting the reel.

2. A cord storage apparatus as claimed in claim 1, wherein at least one of the reel walls is substantially radial and wherein the reel bearing portion is disposed at or adjacent to the circumference of the wall.

3. A cord storage apparatus as claimed in claim 1, wherein at least one of the reel walls defining at least one wall opening formed therein, the wall opening being sufficiently large to allow passage of the proximal plug, the opening also being coupled to the via.

4. A cord storage apparatus as claimed in claim 1 wherein at least one of the reel walls comprises a plurality of arms extending from the hub, and wherein the reel bearing portion comprises an area of the arms distal to the hub.

5. A cord storage apparatus as claimed in claim 1, wherein the reel bearing portion comprises a plurality of bearings and wherein the interfacing of the reel bearing portion and the housing bearing portion occurs via the bearings.

6. A cord storage apparatus as claimed in claim 1, wherein the housing bearing portion comprises a plurality of bearings, and wherein the interfacing of the housing bearing portion and the reel bearing portion occurs via the bearings.

7. A cord storage apparatus as claimed in claim 1 wherein the housing bearing portion is at least partially in direct contact with the reel bearing portion.

8. A cord storage apparatus as claimed in claim 1 wherein the housing having at least one slot defined thereby, the slot being angled to the rotation axis, and dimensioned to allow at the cord to pass therethrough.

9. A cord storage apparatus as claimed in claim 8 wherein the slot is substantially at right angle to the rotation axis.

10. A cord storage apparatus as claimed in claim 8, wherein the slot is dimensioned to allow the distal plug to pass therethrough.

11. A cord storage apparatus as claimed in claim 10 wherein the housing defining a space proximal to the slot for storage of the distal plug.

12. A cord storage apparatus as claimed in claim 1, wherein the reel further comprises at least one handle.

13. A cord storage apparatus as claimed in claim 1 wherein the housing further comprises a carrying handle.

14. A cord storage apparatus as claimed in claim 1 further comprising at least a protrusion disposed on one side of the housing, and a complementary indentation disposed on an opposite side of the housing, in a location allowing mating of the indentation of a first cord storage apparatus with the protrusion of a second cord storage apparatus, for facilitating stacking of a plurality of cord storage apparatuses.

15. A cord storage apparatus as claimed in claim 1 wherein at least one of the reel walls further comprises a reel lateral bearing portion distal to the hub, and the housing having at least one housing lateral bearing portion dimensioned to interface with the reel lateral bearing portion for rotatably supporting the reel.

16. A cord storage apparatus as claimed in claim 15, wherein the housing lateral bearing portion comprises a plurality of bearings, and wherein the interfacing of the housing lateral bearing portion and the reel lateral bearing portion occurs via the bearings.

17. A cord storage apparatus as claimed in claim 1, further comprising a hub lip coupled to the hub perimeter or being integral thereto, the lip extending inwardly into the hub towards the longitudinal axis at or adjacent to the hub opening.

* * * * *